US007485215B2

(12) United States Patent
Jouaffre et al.

(10) Patent No.: US 7,485,215 B2
(45) Date of Patent: Feb. 3, 2009

(54) METHOD OF PRE-HEATING A STACK FOR ALUMINIUM ELECTROLYSIS PRODUCTION

(75) Inventors: Denis Jouaffre, Saint Jean de Maurienne (FR); Jean-Luc Basquin, St. Jean de Maurienne (FR); Claude Vanvoren, La Murette (FR)

(73) Assignee: Aluminium Pechiney, Paris (FR)

( * ) Notice: Subject to any disclaimer, the term of this patent is extended or adjusted under 35 U.S.C. 154(b) by 672 days.

(21) Appl. No.: 10/528,273

(22) PCT Filed: Sep. 18, 2003

(86) PCT No.: PCT/FR03/02745

§ 371 (c)(1),
(2), (4) Date: Mar. 17, 2005

(87) PCT Pub. No.: WO2004/027119

PCT Pub. Date: Apr. 1, 2004

(65) Prior Publication Data

US 2006/0131180 A1 Jun. 22, 2006

(30) Foreign Application Priority Data

Sep. 20, 2002 (FR) ..... 02 11670

(51) Int. Cl.
*C25C 3/06* (2006.01)
*C25C 7/06* (2006.01)

(52) U.S. Cl. ..... 205/390

(58) Field of Classification Search ..... 205/390
See application file for complete search history.

(56) References Cited

U.S. PATENT DOCUMENTS

| | | | | |
|---|---|---|---|---|
| 4,146,444 | A * | 3/1979 | Minick | 205/396 |
| 4,265,717 | A | 5/1981 | Wiltzius | |
| 4,800,102 | A * | 1/1989 | Takada | 427/197 |
| 6,231,745 | B1 * | 5/2001 | Homley et al. | 205/374 |
| 6,338,785 | B1 | 1/2002 | De Nora | |
| 2002/0092774 | A1 * | 7/2002 | Bates et al. | 205/367 |

FOREIGN PATENT DOCUMENTS

JP 57123990 8/1982

OTHER PUBLICATIONS

Sorlie, M. et al. (1994) 'Cathodes in Aluminum Electrolysis', 2nd Ed., Aluminum-verlag. p. 76-83.

* cited by examiner

*Primary Examiner*—Harry D Wilkins, III
(74) *Attorney, Agent, or Firm*—Banner & Witcoff, Ltd.

(57) ABSTRACT

The present invention relates to a method of pre-heating a pot provided with anodes and cathodes for the production of aluminium by electrolysis, said method including a first step, prior to the pot being supplied with current, during which a layer of a granular conductive material is deposited then crushed between the anodes and the cathodes, characterized in that the granular conductive material is graphite-based and in that the layer of granular conductive material only extends, after crushing, over a part of a lower surface of each anode and takes the form of contact blocks.

29 Claims, 1 Drawing Sheet

METHOD OF PRE-HEATING A STACK FOR ALUMINIUM ELECTROLYSIS PRODUCTION

CROSS REFERENCE TO RELATED APPLICATIONS

This application is a §371 national stage application of International Application No. PCT/FR03/002745 filed Sep. 18, 2003, which claims priority to French Application No. 02/11670 filed Sep. 20, 2002.

BACKGROUND OF THE INVENTION

1. Field of the Invention

The present invention relates to a method of pre-heating a pot provided with anodes and cathodes for the production of aluminium by electrolysis.

2. Description of the Related Art

Aluminium is produced industrially by igneous electrolysis, in other words by electrolysis of the alumina in solution in a molten cryolite bath. This bath is contained in a pot including a steel shell, which is coated internally with refractory and/or insulating materials, and a cathode assembly located at the bottom of the pot. Anodes of carbonaceous material are partially immersed in the electrolysis bath. The electrolysis current, which flows in the electrolysis bath and the pad of liquid aluminium via the anodes and the cathode elements, implements the reactions that reduce the alumina and also allows the electrolysis bath to be kept at a temperature of about 950° C.

The pots are arranged in series and are subjected to a current of the same intensity.

However, before the aluminium itself can be produced, it is necessary to warm up the pot, which is initially cold. This is a delicate operation during which thermal shocks need to be avoided. In fact, a pot demands very substantial investment and has a life cycle typically of between 3 and 7 years. It is therefore necessary to take every precaution so as not to reduce the pot's period of service. To this end, the rise in temperature within the pot must be slow, typically of 20° C. per hour.

In a known method of pre-heating, a uniform layer of a granular conductive material is deposited between the anodes and the cathodes, this layer then allowing a method of resistance pre-heating of the pot.

A proposal has already been made to use a carbonaceous material and more particularly coke as the granular conductive material. Using coke produces too high a resistance making it essential to use shunts which are progressively removed (as described in "Cathodes in Aluminium Electrolysis", by M. Sørlie and H. A. Øye, Aluminium Verlag, 1984, pp. 77-83).

SUMMARY OF THE INVENTION

The purpose of the present invention is to resolve the drawbacks previously mentioned, and to this end the invention involves a method of pre-heating a pot provided with anodes and cathodes for the production of aluminium by electrolysis, said method including a first step, prior to the pot being supplied with current, during which a layer of granular conductive material is deposited and then crushed between the anodes and the cathodes, characterised in that the granular conductive material is graphite-based and in that the layer of granular conductive material only extends, after crushing, over a part of the lower surface of each anode.

BRIEF DESCRIPTION OF THE FIGURES

The invention will be better understood by using the detailed description of a preferred embodiment of the invention, which is disclosed below, and the appended figures.

DETAILED DESCRIPTION OF A PREFERRED EMBODIMENT

Figure 1:
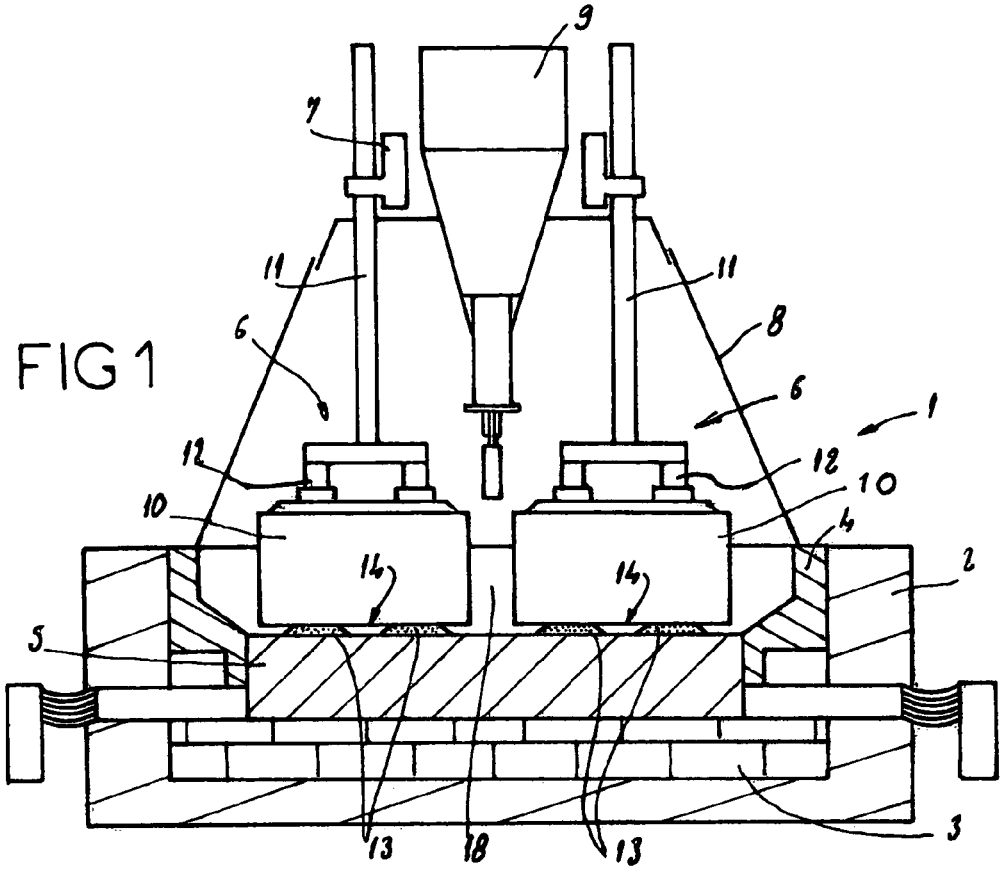
FIG. 1 is a cross-sectional view of a pot after the granular conductive material has been deposited and it has been crushed between the anodes and the cathodes.

In this way, using such a layer of granular conductive material allows the pot to be pre-heated to the required temperature in a reasonable period of time of about 60 hours, but without using shunts, which have drawbacks in terms of safety and productivity. Using graphite on only one part of the contact surface of each anode makes it possible to increase resistance, and thus to accelerate the rise in temperature and to reduce the duration of the operation.

Moreover, it is possible to obtain a more homogeneous temperature of the cathodes within the pot. On the one hand, this effect stems from the improvement in the reproducibility of the overall resistance offered by the layer of granular conductive material. Indeed, this resistance depends on the pressure exerted on the layer and on the thickness of this layer. A well chosen surface/thickness relationship will then make it possible to obtain an overall resistance that is not very sensitive to variations in these parameters and will generate fewer hot spots on the cathodes. On the other hand, the way the granular material is placed allows the resistance to be adapted so as to obtain the greatest possible uniform heating profile. Indeed, the degree of freedom obtained by not covering the whole contact surface of each anode makes it possible to accentuate the heating of parts which are the most subject to thermal losses.

Another advantage of this method lies in the fact that the quantity of carbon dust to be removed from the electrolysis bath after starting the pot is markedly smaller.

Preferentially, the layer of granular conductive material covers, after crushing, between 5 and 40%, typically from 5 to 20%, of the lower surface of each anode.

Said carbonaceous material layer preferably takes the form of contact blocks. In other words, for each anode, the layer of granular conductive material is, preferably, deposited in the form of contact blocks. The number of the latter is advantageously between 3 and 20, inclusively, and is typically between 4 and 8, inclusively.

These contact blocks may be aligned, but may also be arranged in staggered rows, or even asymmetrically. Moreover, these contact blocks may be of different sizes and have any general shape in cross-section, particularly circular or oval. In particular, two or more contact blocks may have a cross-section of different sizes (corresponding to different diameters in the case of contact blocks with a circular cross-section). A larger concentration of contact blocks may be provided in the vicinity of some parts of the pot, for example the walls of the pot, so as to obtain a satisfactory temperature rise throughout the pot.

Preferentially, each contact block has an initial thickness, before crushing, of between 0.5 and 4 cm. After crushing, the thickness is typically between 0.5 and 3 cm. In a particularly advantageous way, each contact block is about 3 cm thick before crushing and about 2 cm thick after crushing respectively.

Preferentially, the contact blocks are made using a template placed on the cathodes and including a plate fitted with several orifices into each of which granular conductive material is inserted.

Advantageously, 90 to 95% of the graphite grains of the granular conductive material are between 1 and 8 mm in size. This granular conductive material, graphite-based, may also include at least one other material that is able to vary its resistivity, such as an under-calcined carbonaceous material or alumina.

The invention also relates to a method of pre-heating a pot for the production of aluminium, including the following steps:

forming a layer of granular conductive material over a part of the surface of a cathode, laying each anode on the layer of granular material, establishing an electrical connection between the stem of each anode and the anode frame, energizing the pot so as to cause an electric current to flow between the cathodes and the anodes.

Laying each anode on the layer of granular material leads to the compressing of this layer, which is generally crushed under the effect of the weight of the anode assembly.

As shown in FIG. 1, a pot 1 for the production of aluminium by electrolysis typically includes a metal shell 2 internally lined with refractory materials 3, 4, cathodes 5 of carbonaceous material, anode assemblies 6, an anode frame 7, means 8, such as hoods, to recover the effluents given out by the pot 1 in operation, and means 9 to supply the pot with alumina and/or with $AlF_3$. The anode assemblies 6 each include at least one anode (or anode block) 10 and a stem 11, the latter typically having a multipode 12 to anchor the anode 10.

For the purpose of pre-heating the pot 1, and before the pot is energized and an electric current is made to flow between the cathodes 5 and the anodes 10, a first step was taken during which contact blocks 13 of an essentially graphite-based granular conductive material 25 were placed and then crushed between the cathodes 5 and the anodes 10. More precisely, the different contact blocks 13 are placed in a discontinuous way between the cathodes 5 and the lower surface (or "contact surface") 14 of each of the anodes 10. Each contact surface 14 is then partially in contact with the granular conductive material 25. The latter is, advantageously, made using grains with 90 to 95% of them having a grain size distribution of between 1 and 8 mm. These contact blocks 13 are advantageously placed so as to heat more the periphery than the centre of each cathode 5, which is generally hotter. In operation, the parts near the walls of the pot 1 may thus benefit from a more efficient rise in temperature.

Tests have been carried out on a number of Pechiney AP-30 pots in which four contact blocks similar to those previously described were placed for each anode, the pots being furthermore equipped with graphitic cathode blocks. The tests were carried out at an amperage of 305 kA, the energizing being effected without a shunt by removing the elements which short-circuit the pot.

Figure 2:
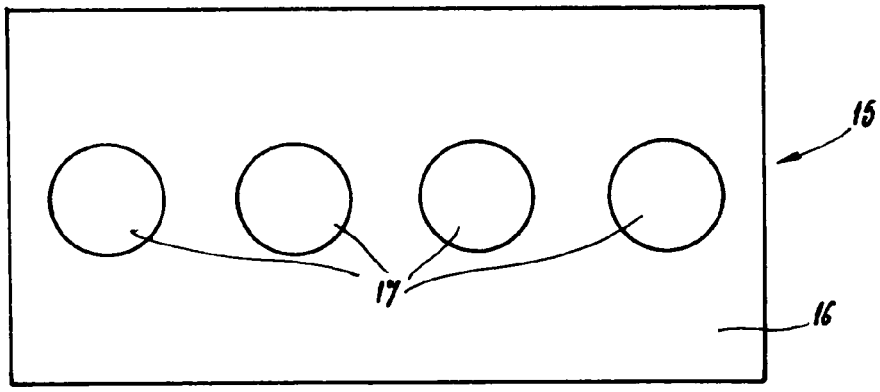
FIG. 2 is a view from above of a template allowing the contact blocks to be deposited within the pot.
Figure 3:
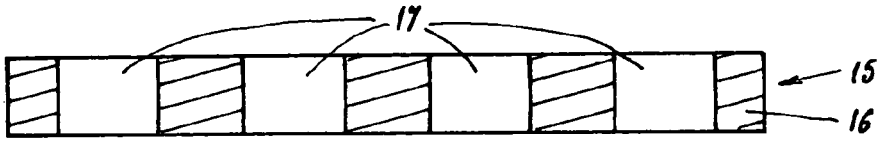
FIG. 3 is a transverse cross-sectional view of the template shown in FIG. 2.

As shown in FIGS. 2 and 3, a template 15 was used to position the contact blocks 13 in the pot 1 before putting the anode assemblies 6 in place. More precisely, such a template 15 is made in the form of a plate 16 comprising several aligned orifices 17, which are four in number in the present case. The plate 16 is about 1.50 m long, 65 cm wide, and 3 cm thick. The orifices 17 are substantially circular and are about 20 cm in diameter.

Figure 4:
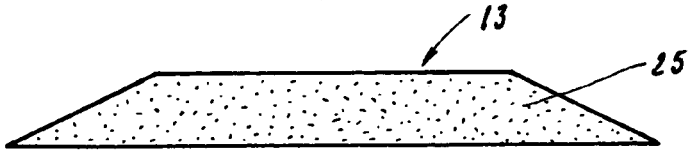
FIG. 4 is a view of a contact block of granular conductive material after the template has been removed.

This plate 16 is first of all placed in the pot 1 in contact with a cathode 5. The orifices 17 are then filled using the granular conductive material 25, and the plate 16 is finally removed. As shown in FIG. 4, when the plate 16 is removed, each contact block 13 of granular conductive material 25 widens slightly and is transformed into a truncated cone with a diameter of 20 to 24 cm at the base and a diameter of 14 to 16 cm at the top. The truncated cones are then crushed under the weight of each anode assembly.

The tops of the anodes and the central corridor 18 have been heat-insulated with rock wool, and sheets of rock wool have been applied against the outer faces of the anodes. The periphery of the pots was filled with crushed bath and with sodium carbonate, and the hoods provided to improve thermal isolation and the catching gases given off by the lining paste were fixed in place in the hours following energizing.

Eleven thermocouples were inserted on the surface of the anode blocks as follows: three were inserted in the central corridor, two in each of the two lateral corridors, one at each of the two heads, and two in opposite angles.

After 60 hours of pre-heating, the temperature recorded by each of the thermocouples located in the central corridor was within a range of 850 and 1000° C. All the other thermocouples were above the targeted minima, namely, over 700° C. in the heads, over 600° C. in the lateral corridors, and over 500° C. in the angles. Moreover, no hot spot was apparent on the cathodes. Finally, the rise in temperature in the central corridor was achieved at all times at below 30° C. per hour.

It should be noted that the anode stems may advantageously be connected to the anode frame using pre-heating flexible assemblies.

Although the invention has been described in relation to particular embodiment examples, it is quite obvious that it is in no way restricted to these and that it includes all the technical equivalents of the means described as well as their combinations if they are within the framework of the invention.

REFERENCE NUMBERS

1 Electrolysis pot
2 Shell
3,4 Refractory material
5 Cathode
6 Anode assembly
7 Anode frame
8 Hoods
9 Pot supply means
10 Anode
11 Stem
12 Multipode
13 Contact block
14 Lower surface of an anode
15 Template
16 Plate
17 Orifice
18 Central corridor
25 Granular conductive material

The invention claimed is:

1. A method of pre-heating a pot for the production of aluminium by electrolysis, comprising:

depositing a layer of a granular conductive material between an anode and a cathode of the pot, the granular conductive material being predominately graphite; and crushing the granular conductive material between the anode and the cathode, wherein the layer of granular conductive material extends, after crushing, over a part of a lower surface of the anode and takes the form of contact blocks.

2. Method according to claim 1, wherein the layer of granular conductive material covers, after crushing, from 5 to 40% of the lower surface of each anode.

3. Method according to claim 2, wherein the layer of granular conductive material covers, after crushing, from 5 to 20% of the lower surface of each anode.

4. Method according to claim 2, wherein the contact blocks have, in cross-section, a general circular or oval shape.

5. Method according to claim 2, wherein each contact block has an initial thickness of from 0.5 to 4 cm.

6. Method according to claim 2, wherein the contact blocks are made using a template placed on the cathode and including a plate fifed with several orifices into each of which granular conductive material is inserted.

7. Method according to claim 2, wherein 90 to 95% of the graphite grains of the granular conductive material are from 1 to 8 mm in size.

8. Method according to claim 2, wherein the granular conductive material additionally includes at least one other material that is able to vary its resistivity.

9. Method according to claim 2, further comprising:

forming a layer of the granular conductive material over a part of the surface of the cathode, laying the anode on the layer of granular material, establishing an electrical connection between the stem of the anode and an anode frame, and energizing the pot so as to cause an electric current to flow between the cathode and the anode.

10. Method according to claim 1, wherein a number of contact blocks associated with the anode is from 3 to 20.

11. Method according to claim 1, wherein the contact blocks have, in cross-section, a general circular or oval shape.

12. Method according to claim 11, wherein each contact block has an initial thickness of from 0.5 to 4 cm.

13. Method according to claim 11, wherein the contact blocks are made using a template placed on the cathode and including a plate fitted with several orifices into each of which granular conductive material is inserted.

14. Method according to claim 11, wherein 90 to 95% of the graphite grains of the granular conductive material are from 1 to 8 mm in size.

15. Method according to claim 1, wherein each contact block has an initial thickness of from 0.5 to 4 cm.

16. Method according to claim 1, wherein the contact blocks are made using a template placed on the cathode and including a plate fifed with several orifices into each of which granular conductive material is inserted.

17. Method according to claim 1, wherein 90 to 95% of the graphite grains of the granular conductive material are from 1 to 8 mm in size.

18. Method according to claim 1, wherein the granular conductive material additionally includes at least one other material that is able to vary its resistivity.

19. Method according to claim 1, further comprising:

forming a layer of the granular conductive material over a part of the surface of the cathode, laying the anode on the layer of granular material, establishing an electrical connection between the stem of the anode and the an anode frame, and energizing the pot so as to cause an electric current to flow between the cathode and the anode.

20. Method according to claim 1, wherein two or more contact blocks have a cross-section of different sizes.

21. Method according to claim 1, wherein the layer of granular conductive material is deposited between a plurality of anodes and at least one cathode of the pot, wherein the granular conductive material is crushed between a plurality of anodes and the at least one cathode, and wherein the layer of granular conductive material extends, after crushing, over a part of a lower surface of each anode.

22. A method of pre-heating a pot for the production of aluminium by electrolysis, comprising:

inserting a granular conductive material between an anode and a cathode of the pot, the granular conductive material being predominately graphite;

placing the anode and the cathode into contact with the granular conductive material; and energizing the pot so as to cause an electric current to flow between the cathode and the anode, through the granular conductive material.

23. Method of claim 22, further comprising:

crushing the granular conductive material between the anode and the cathode, wherein the layer of granular conductive material extends, after crushing, over a part of a lower surface of the anode and takes the form of contact blocks.

24. Method of claim 23, wherein the contact blocks are made using a template placed on the cathode and including a plate fitted with several orifices into each of which the granular conductive material is inserted.

25. Method according to claim 23, wherein a number of contact blocks associated with the anode is from 3 to 20.

26. Method according to claim 23, wherein two or more contact blocks have a cross-section of different sizes.

27. Method according to claim 22, wherein the granular conductive material is inserted between a plurality of anodes and at least one cathode of the pot, wherein the plurality of anodes and the at least one cathode are placed into contact with the granular conductive material, and wherein the electric current flows, upon energizing, between the plurality of anodes and the at least one cathode.

28. Method according to claim 22, wherein 90 to 95% of the graphite grains of the granular conductive material are from 1 to 8 mm in size.

29. Method according to claim 22, wherein the granular conductive material additionally includes at least one other material that is able to vary its resistivity.

* * * * *